US006357529B1

(12) United States Patent
Kent et al.

(10) Patent No.: US 6,357,529 B1
(45) Date of Patent: Mar. 19, 2002

(54) SUBSEA COMPLETION SYSTEM WITH INTEGRAL VALVES

(75) Inventors: Richard Kent, Fife; Nicholas Gatherar, Midlothian, both of (GB)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/501,813

(22) Filed: Feb. 10, 2000

(30) Foreign Application Priority Data

Feb. 11, 1999 (GB) ..... 9903131

(51) Int. Cl.[7] ..... E21B 33/035; E21B 33/038; E21B 34/04

(52) U.S. Cl. ..... 166/344; 166/86.3; 166/360; 166/368

(58) Field of Search ..... 166/368, 360, 166/350, 316, 344, 379, 85.1, 90.1, 86.3

(56) References Cited

U.S. PATENT DOCUMENTS

| | | | | | |
|---|---|---|---|---|---|
| 3,955,622 | A | * | 5/1976 | Jones | 166/352 |
| 4,010,928 | A | | 3/1977 | Smith | 251/31 |
| 4,572,298 | A | | 2/1986 | Weston | 166/379 |
| 4,582,293 | A | * | 4/1986 | Jones | 251/1.3 |
| 4,809,733 | A | | 3/1989 | Hawkins | 137/236.1 |
| 4,860,826 | A | * | 8/1989 | Land | 166/80 |
| 4,934,652 | A | | 6/1990 | Golden | 251/63.6 |
| 5,285,852 | A | * | 2/1994 | McLeod | 166/379 |
| 5,575,336 | A | * | 11/1996 | Morgan | 166/330 |
| 5,746,249 | A | * | 5/1998 | Wright et al. | 137/614.19 |
| 5,868,204 | A | * | 2/1999 | Pritchett et al. | 166/368 |
| 5,884,706 | A | * | 3/1999 | Edwards | 166/335 |
| 5,971,077 | A | * | 10/1999 | Lilley | 166/368 |
| 5,988,282 | A | * | 11/1999 | Jennings et al. | 166/348 |
| 5,992,527 | A | * | 11/1999 | Garnham et al. | 166/379 |
| 6,050,339 | A | * | 4/2000 | Milberger | 166/368 |
| 6,053,252 | A | * | 4/2000 | Edwards | 166/348 |
| 6,065,542 | A | * | 5/2000 | Lalor et al. | 166/348 |

FOREIGN PATENT DOCUMENTS

| | | | | |
|---|---|---|---|---|
| EP | 0624711 A1 | * | 11/1994 | E21B/34/02 |
| EP | 0 624 711 A1 | | 11/1994 | |
| EP | 0 845 577 A1 | | 6/1998 | |
| FR | 002667116 A1 | * | 3/1992 | E21B/43/25 |
| GB | 1 204 072 | | 9/1970 | |
| GB | 2 168 463 | | 6/1986 | |
| WO | WO-99/18329 A1 | * | 4/1999 | E21B/33/035 |

* cited by examiner

*Primary Examiner*—David Bagnell
*Assistant Examiner*—Jennifer H. Gay
(74) *Attorney, Agent, or Firm*—Pauley Petersen Kinne & Erickson

(57) ABSTRACT

A subsea completion having an in-line Christmas tree received within a wellhead. The in-line Christmas tree having at least one valve closure element, for example valve gates. Valve actuator couplings, for example push rods are operatively engaged with the valve closure elements and extend through walls of the in-line Christmas tree and wellhead. Relatively bulky valve actuator mechanisms may therefore be mounted externally of the wellhead, with only the relatively small and unobtrusive actuator couplings extending into the wellhead and tree interiors. The in-line tree is used together with a jumper module, secured and sealed to the wellhead, and a separate flow control package.

19 Claims, 3 Drawing Sheets

SUBSEA COMPLETION SYSTEM WITH INTEGRAL VALVES

FIELD OF THE INVENTION

This invention relates to subsea completions incorporating isolation valves for well containment and other purposes.

BACKGROUND OF THE INVENTION

Subsea Christmas tree tubing hangers typically have wireline plugs installed in the production bore as a barrier to enable removal of the BOP. The setting and sealing of the wireline plugs is both unreliable and time-consuming, especially at increased well depths. Additionally, it would be advantageous to avoid having to pull the wireline plugs through the riser, as this necessitates an expensive lower riser package/emergency disconnect package trip.

European Patent No 0845577 discloses a wellhead assembly having an in-line tree received within a wellhead housing and forming a production bore including a pair of remotely actuated ball valves. This eliminates the need to set wireline plugs in the production bore and has further operational advantages. In particular, it allows the tree and, tubing hanger to be run without disconnecting the BOP, and allows removal of a separate horizontal tree connected to the wellhead, without use of a BOP. However the valves and their actuators take up a relatively large amount of space within the wellhead. Consequently the wellhead and the tubing hanger received in it must also been made relatively large in diameter. The ball valves used also have relatively limited wireline shearing capabilities.

European Patent No. 0624711 discloses a tubular member in which is landed a valve assembly having a gate valve. Actuators positioned externally of the tubular member include actuating stems in engagement with opposite sides of the valve gate.

SUMMARY OF THE INVENTION

The present invention provides a subsea completion having an in-line Christmas tree received within a wellhead, the in-line Christmas tree including a valve closure element; a valve actuator coupling being operatively engaged with the valve closure element and extending through walls of the in-line Christmas tree and wellhead, and a jumper module that can be secured and sealed to the wellhead and connected to an independent flow control package. Relatively bulky valve actuator mechanisms may therefore be mounted externally of the wellhead, with only the relatively small and unobtrusive actuator coupling extending into the wellhead and tree interiors. The size of the tree, tubing hanger and wellhead may thus be kept reasonably small. The actuator coupling can be operated either manually, or hydraulically with optional manual override. In both cases the manual operation may be performed by an ROV. The introduction of valves contained within the wellhead obviates the use of wireline plugs, thereby reducing trip times, providing remote operation without wireline trips and increasing system reliability.

If required, the valve closure element can also be used to shear wireline, coiled tubing or the like passing through the in-line Christmas tree, in addition to sealing the bore in which the valve closure element is situated. The valve closure element is preferably a valve gate, which provides excellent shearing capability and is the preferred oil industry valve closure element for a subsea system.

The actuator coupling may be a rising stem type actuator shaft attached to the valve gate, or alternatively a longitudinally fixed threaded shaft engaged with a lift nut in the valve gate. Preferably however, the actuator coupling comprises a pair of push rods each extending through the wellhead wall and arranged to press on opposed edges of the valve gate to move it between open and closed positions. On withdrawal of the push rods there is no interconnection between the in-line tree and its valve actuators. The in-line tree and valve actuators therefore may be installed or removed independently of each other.

Providing the valve closure element as an integral part of the completion allows the completion to be rapidly isolated without the need to run wireline plugs. There is then no need to run a lower riser package and emergency disconnect package on a completions riser that would otherwise be required to control intervention to the well and to remove wireline plugs prior to flowing the well.

Integration of valve closure elements or closure valves within both the production and annulus bores of the completion will ensure rapid and reliable sealing.

There are further operational benefits from this invention. The valve closure element will allow the wellhead to be easily sealed after installation of the completion components using a drilling vessel. This can allow drilling and suspension of the well at an early stage, so that at a later date a more basic installation vessel can recommence the installation of the subsea Christmas tree system. This will avoid using the drilling vessel for a lengthy Christmas tree installation and will therefore reduce costs.

Additional operational flexibility can be obtained by using the jumper module secured and sealed to the wellhead in place of an integrated flow control module comprising a subsea Christmas tree. This jumper module is then connected to an independent flow control package which contains the necessary flow control equipment.

The wellhead may be of unitary construction, or may comprise a separate tubing spool secured to a wellhead lower part and containing the in-line tree.

Further preferred features are described below in connection with illustrative embodiments of the invention shown in the drawings.

DESCRIPTION OF THE PREFERRED EMBODIMENTS

Figure 1:
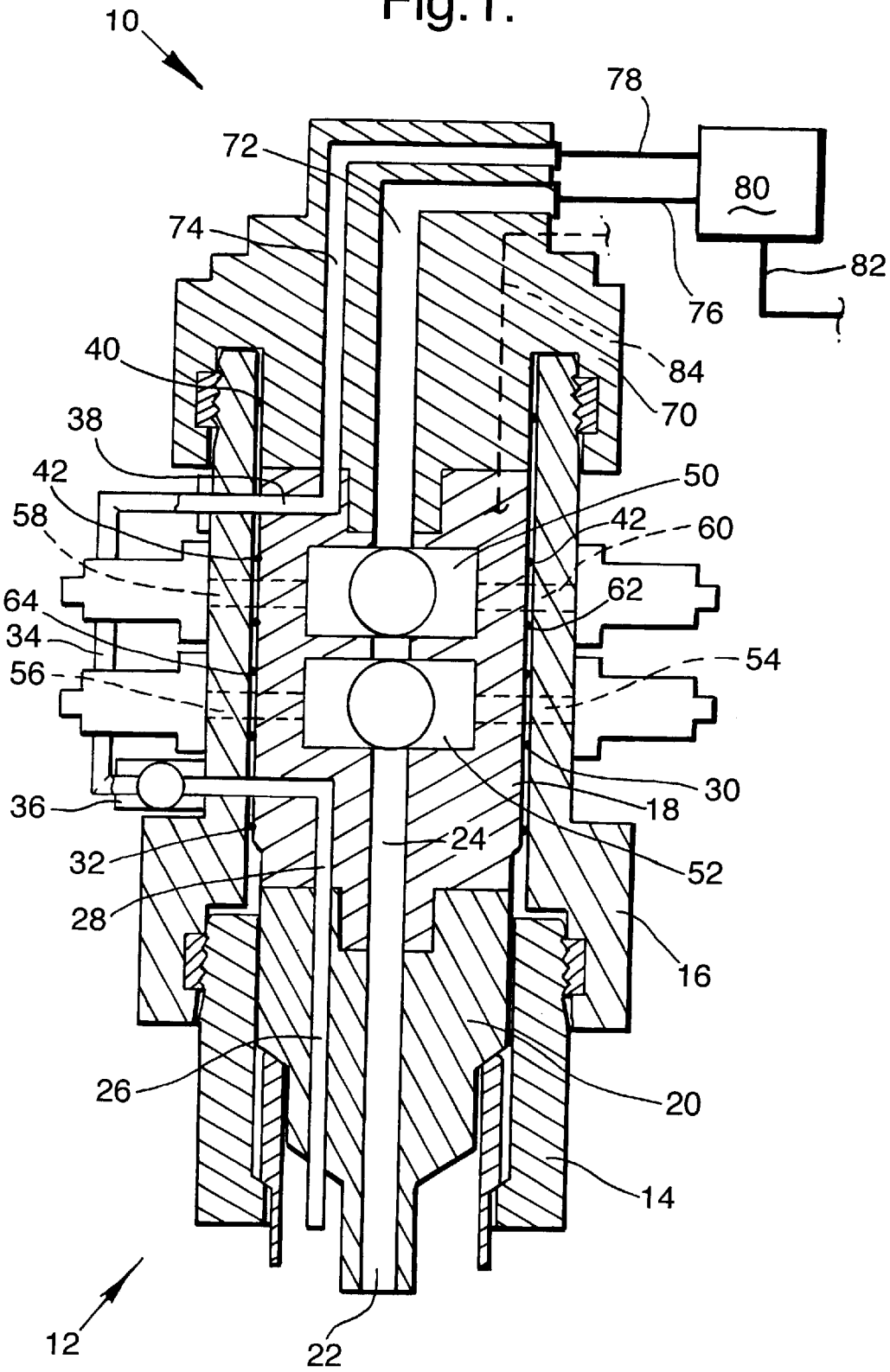
FIG. 1 is a diagrammatic cross-section of a wellhead and completion with a jumper module, embodying the invention.

The completion 10 shown in FIG. 1 is used with a wellhead 12 comprising a lower part 14 to which is secured a tubing spool 16. An in-line tree 18 is housed within the tubing spool 16, above a tubing hanger 20. A production flow bore 22 in the tubing hanger is in sealed communication with a production flow bore 24 of the in-line tree 18. Similarly an annulus flow conduit 26 in the tubing hanger communicates with a lower annulus flow passage 28 in the in-line tree 18. A pair of annular seals 30, 32 connect the lower passage 28 to an external bypass loop 34 whose ends extend through the tubing spool wall. A hydraulically or ROV operated valve 36 is positioned in the bypass loop 34. The upper end of the bypass loop 34 is connected to an upper annulus flow passage 38 in the in-line tree 18 by a pair of annular seals 40, 42. The upper annulus flow passage 38 in turn communicates with an annulus conduit 74 in a jumper module 70. The in-line tree production bore 24 is in sealed communication with a production bore 72 of the jumper module 70.

The production bore 24 in the in-line tree 18 contains a pair of gate valves 50, 52 actuated by opposed actuator coupling shafts in the form of push rods 54, 56, 58, 60. These extend through ports in the tubing spool 16, which ports are sealed to the in-line tree 18 by the annular seals 30, 42 and additional annular seals 62 and 64. Together these seals also serve to define chambers of the valves 50, 52, as further described below.

The simple jumper module 70 containing no valves acts as a connector externally matable with the tubing spool 16 following installation of the in-line tree 18. The production bore 72 and annulus conduit 74 in the jumper module 70 are respectively connected to jumper lines 76, 78 communicating with a flow control package 80 containing such valves as may be necessary to control the production and annulus flows in a given well development, thus replacing the function of a subsea Christmas tree. The flow control package 80 is connected to a production flow line or manifold 82 and may contain other equipment essential to the particular well development, such as a production choke, chemical injection ports, and control/monitoring equipment. The jumper module 70 may also contain penetrations for electrical, fiber optic and/or hydraulic downhole service lines, as schematically illustrated at 83. These lines may be connected to the flow control module 80 or to another nearby subsea controls center (not shown).

Figure 2:
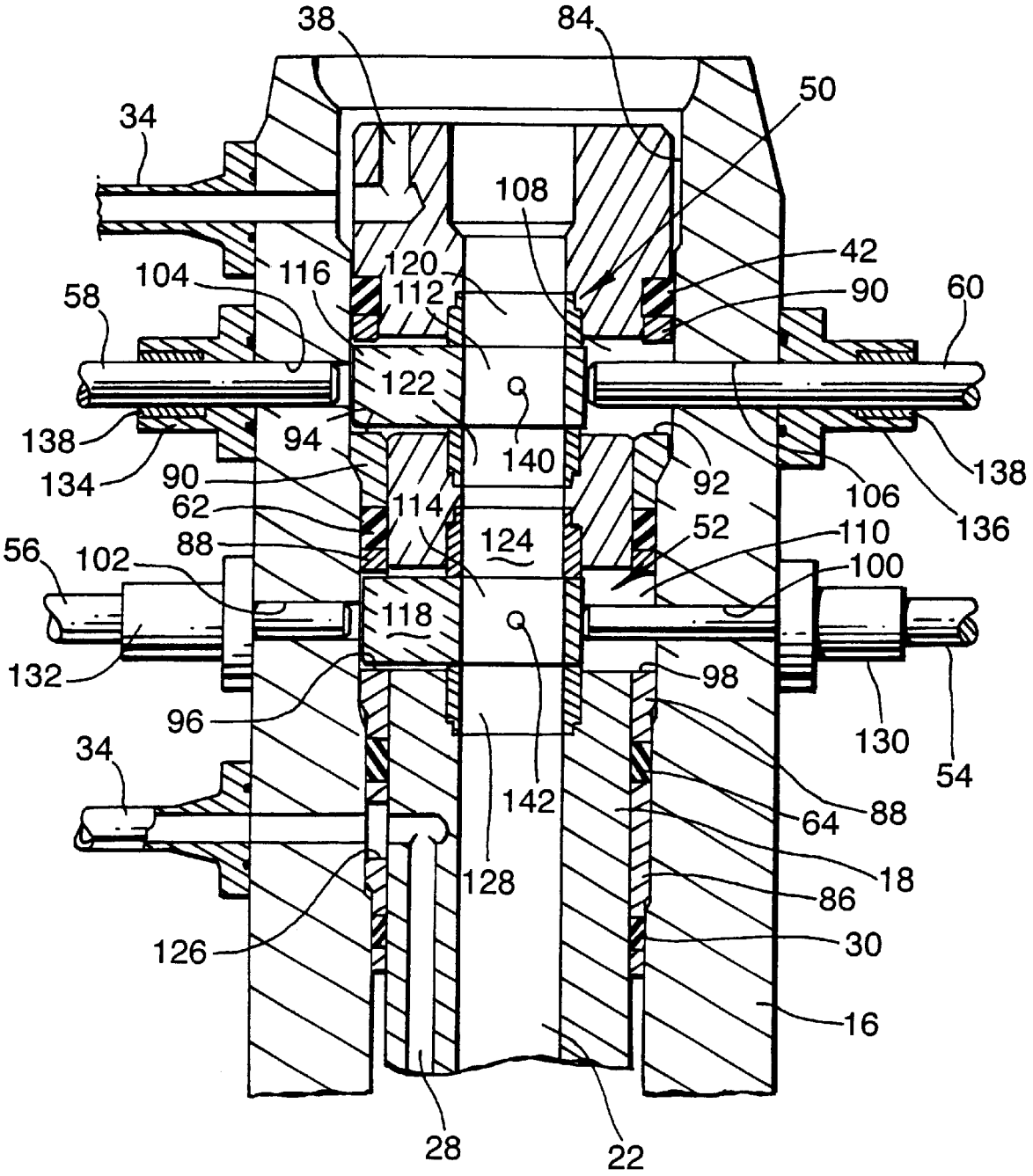
FIG. 2 shows details of an in-line tree, valve gates and actuator couplings as may be used in the embodiment of FIG. 1.
Figure 3:
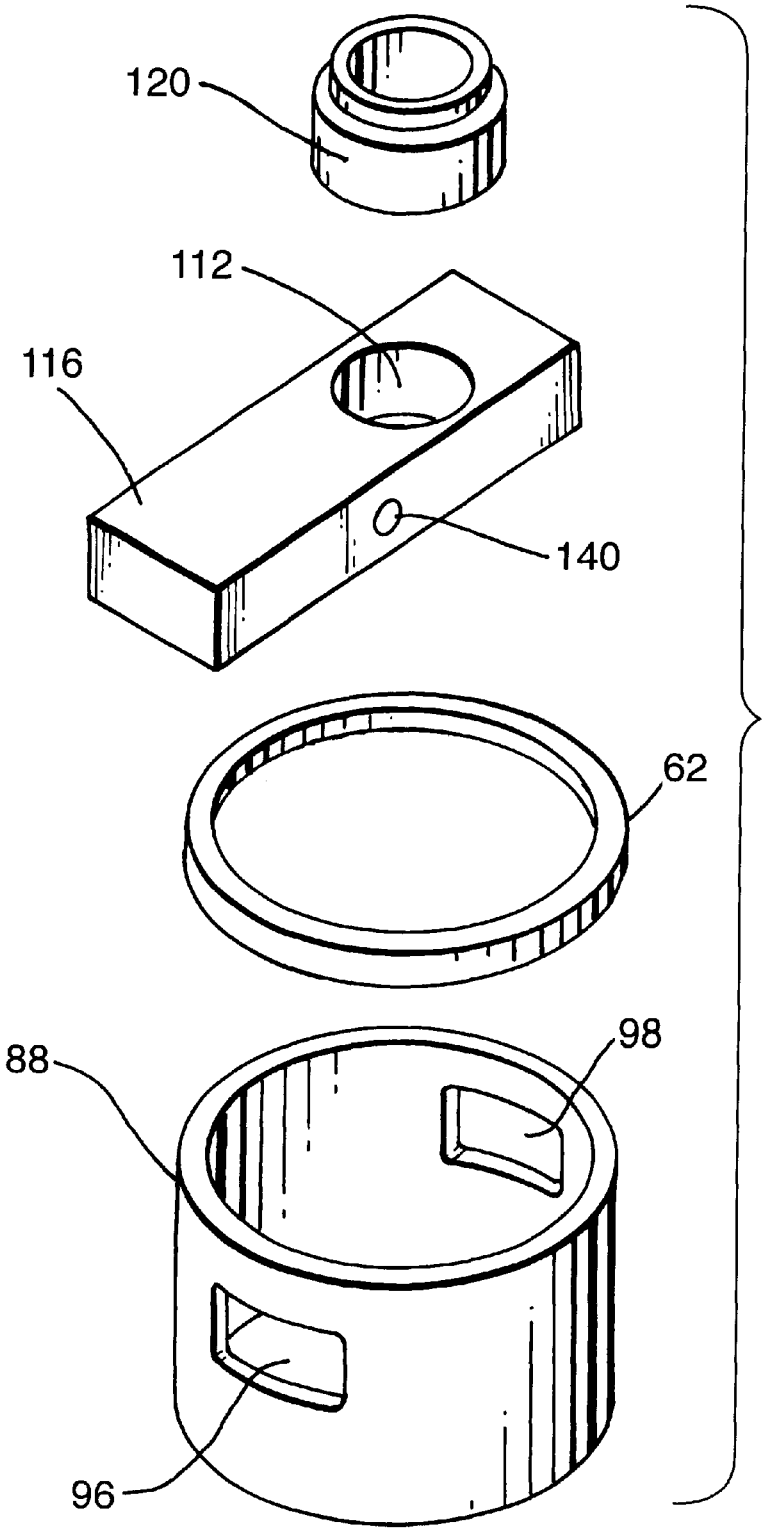
FIG. 3 is a perspective view showing various components of the assembly illustrated in FIG. 2.

FIGS. 2 and 3 show components of the in-line tree 18 and its gate valves in more detail. The in-line tree 18 is sealed at its outer circumference to the tubing spool wall inner surface 84 by the circumferential seals 30, 42, 62, 64. These seals are longitudinally separated by spacer/energizing rings 86, 88 and 90. Ring 86 contains a single port 126 in alignment with the bypass loop 34 and annulus flow passage 28 to allow fluid communication between these.

Rings 88 and 90 each include two ports 96, 98 and 92, 94 respectively. These are aligned with ports 100, 102, 104, 106 in the tubing spool 16 for reception of the push rods 54, 56, 58, 60. Cavities 108 and 110 extend transversely through the walls of the in-line tree 18, intersecting with the production bore 22 and aligned with the ports 104, 94, 92, 106 and 102, 96, 98, 100 respectively. Valve gates 116, 118 containing through bores 112, 114 are received within the cavities 108, 110 respectively.

Actuator coupling shaft 60 may thus be extended through the ports 106, 92 to push the gate 116 towards and partly into the port 94, thereby bringing the through bore 112 and in-line tree bore 22 into alignment, to open gate valve 50. Actuator coupling shaft 58 may be extended through the ports 104, 94 to push the gate 116 towards and partly into the port 92, bringing the through bore 112 out of alignment with the in-line tree bore 22, to close the valve 50. Push rods 54 and 56 act similarly to move gate 118 and open and close valve 52. Floating valve seats 120, 122 and 124, 128 are provided in seat pockets formed in the tree production bore 22, to seal against the valve gates 116 and 118 respectively, in a manner well known to those in the gate valve art. The push rods 54, 56, 58, 60 extend through bushes 130, 132, 134, 136 bolted and sealed to the tubing spool 16. These bushes contain packings 138 (only shown in relation to bushings 134, 136, which are illustrated in section) which cooperate with the seals 64, 62, 42 to seal the valve cavities 108, 110. Drillings 140, 142 extending from the through bores 112, 114 to the valve cavities 108, 110 assist in pressurising the valve cavities 108, 110 and hence in maintaining the seat to gate seals, in known manner. If containment of pressure below the in-line tree is required without the need to seal against back pressure from above the in-line tree, seats 122 and 128 may be omitted.

FIG. 3 shows the seat 120, gate 116, seal 62 and spacer ring 88 in perspective.

If desired, the bypass loop 34 and valve 36 may be incorporated into the body of the in-line tree, with the valve 36 operated by actuator coupling shafts in similar manner to valves 50 and 52. The actuator coupling shafts may be moved manually, including by ROV, or by any suitable linear actuator positioned externally of the tubing spool. For example, known hydraulic valve actuators incorporating a manual override may be used. In known manner, the valve gates and/or seats may be equipped with hardened faces or inserts suitable for shearing wirelines, coiled tubing and other objects inserted through the in-line tree production bore 22.

Although illustrated as a separate component, the in-line tree and its valve closure element or elements can if desired be integrated into the tubing hanger received within the wellhead or tubing spool.

The invention is ideal for deep water developments where it provides substantial savings in installation and trip times, although it also provides advantages of improved reliability and ease of use in shallower waters.

What is claimed:

1. A subsea completion system comprising:

a wellhead;

an in-line Christmas tree received within the wellhead, the in-line Christmas tree having a valve closure element;

a valve actuator coupling operatively engaged with the valve closure element, the valve actuator coupling extending through a wall of the in-line Christmas tree and a wall of the wellhead;

a valveless jumper module secured and sealed to the wellhead;

an independent flow control package; and a jumper connected at a first end portion to the jumper module and at a second end portion to the independent flow control package for fluid communication therebetween.

2. A subsea completion system in accordance with claim 1, wherein the valve closure element is a valve gate.

3. A subsea completion system in accordance with claim 2, wherein the valve actuator coupling comprises a pair of push rods, each of the push rods extending through the wall of the wellhead and arranged to press on opposed edges of the valve gate to move the valve gate between an open position and a closed position.

4. A subsea completion system in accordance with claim 1, comprising a tubing spool secured to a lower part of the wellhead, the in-line Christmas tree housed within the tubing spool.

5. A subsea completion system in accordance with claim 1, wherein the in-line Christmas tree and the valve closure element are integrated into a tubing hanger received within the wellhead.

6. A subsea completion system for use with a wellhead, comprising:

a tubing spool connected to a lower part of the wellhead;

an in-line tree housed within the tubing spool, the in-line tree forming an in-line tree production flow bore;

a valveless jumper module connected to the in-line tree, the jumper module forming a jumper module production bore in communication with the in-line tree production flow bore; and a jumper connected at a first end portion to the jumper module and at a second end portion to an independent flow control package for fluid communication therebetween, wherein at least two gate valves are positioned with respect to the in-line tree production bore, the at least two gate valves actuated by opposed actuator coupling shafts.

7. A subsea completion system in accordance with claim 6, wherein the opposed actuator coupling shafts for actuating the at least two gate valves comprise a plurality of push rods, the push rods extending through corresponding ports in the tubing spool.

8. A subsea completion system in accordance with claim 7, wherein each of said ports is sealed by an annular seal.

9. A subsea completion system in accordance with claim 6, further comprising:

a lower annulus flow passage positioned within the in-line tree;

a tubing hanger positioned below the in-line tree;

an annulus flow conduit positioned within the tubing hanger, the annulus flow conduit in communication with the lower annulus flow passage;

an external bypass loop positioned within the in-line tree, the external bypass loop having a lower end connected to the lower annulus flow passage and an upper end connected to an upper annulus flow passage; and a jumper module annulus conduit positioned within the jumper module and connected to the upper annulus flow passage.

10. A subsea completion system in accordance with claim 9, comprising a flow control package connected with respect to the jumper module production bore and the jumper module annulus conduit to control a production flow and an annulus flow in a well development.

11. A subsea completion system comprising:

a tubing spool having a first port for receiving a first actuator shaft and a second port for receiving a second actuator shaft;

an in-line tree housed within the tubing spool, the in-line tree forming an in-line tree production bore;

a first cavity formed transversely through the in-line tree, the first cavity intersecting the in-line tree production bore and aligned with the first port and the second port;

a first valve gate having a through bore received within the first cavity, the first valve gate moveable between an open position and a closed position; and a spacer ring positioned circumferentially about the in-line tree, the spacer ring having a first port aligned with the first port of the tubing spool and a second port aligned with the second port of the tubing spool;

wherein the first actuator shaft extends through the first port to move the first valve gate to the open position and a second actuator shaft extends through the second port to move the first valve gate to the closed position.

12. A subsea completion system in accordance with claim 11, wherein the in-line tree is sealed at a circumference to an inner wall surface of the tubing spool by a plurality of circumferential seals.

13. A subsea completion system in accordance with claim 12, wherein the circumferential seals are longitudinally separated from each circumferential seal by a spacer ring.

14. A subsea completion system in accordance with claim 11, wherein a seat pocket having a first floating valve seat and an opposing second floating valve seat are positioned within the in-line tree production bore to seal against the first valve gate.

15. A subsea completion system in accordance with claim 11, wherein the in-line tree production bore is in communication with a tubing hanger production bore.

16. A subsea completion system in accordance with claim 11, comprising a flow control package connected to a production flow line.

17. A subsea completion system in accordance with claim 11, further comprising:

a third port for receiving a third actuator shaft formed in the tubing spool;

a fourth port for receiving a fourth actuator shaft formed in the tubing spool;

a second cavity formed transversely through the in-line tree, the second cavity intersecting the in-line tree production bore;

a second valve gate having a through bore received within the second cavity, the second valve gate moveable between an open position and a closed position;

wherein the third actuator shaft extends through the third port to move the second valve gate to the open position and the fourth actuator shaft extends through the fourth port to move the second valve gate to the closed position.

18. A subsea completion system in accordance with claim 17, wherein a second seat pocket having a third floating valve seat and an opposing fourth floating valve seat are positioned within the in-line tree production bore to seal against the second valve gate.

19. A subsea completion system in accordance with claim 17, wherein a drilling extends through the through bore into the second cavity to pressurize the second cavity.

* * * * *